US005305474A

United States Patent [19]

Nardi et al.

[11] Patent Number: 5,305,474

[45] Date of Patent: Apr. 26, 1994

[54] STOPPABLE FLUSHING MECHANISM WITH ASSURED MINIMAL FLOW

[75] Inventors: Bernard Nardi, Gemenos; Michel Pourcier, Marseille, both of France

[73] Assignee: Societe Phoceene de Matieres Plastiques, SPMP, Marseille, France

[21] Appl. No.: 111,432

[22] Filed: Aug. 25, 1993

Related U.S. Application Data

[63] Continuation of Ser. No. 723,071, Jun. 28, 1991, abandoned.

[51] Int. Cl.[5] ..... E03D 1/14

[52] U.S. Cl. ..... 4/324; 4/379

[58] Field of Search ..... 4/378, 379, 381, 394–401, 4/324, 325

[56] References Cited

U.S. PATENT DOCUMENTS 4,357,720 11/1982 Stahli ..... 4/378 X
4,557,000 12/1985 Strangfeld ..... 4/378 X
4,956,880 9/1990 Bailet ..... 4/378 X

*Primary Examiner*—Charles E. Phillips

*Attorney, Agent, or Firm*—Sandler Greenblum & Bernstein

[57] ABSTRACT

Stoppable flushing mechanism having an assured minimum flow of water is provided with an evacuation orifice having a sealing edge adapted to be positioned in a base of a flushing tank, and a substantially axially movable valve capable of being applied to the sealing edge. A substantially axially movable floater is affixed to the valve and adapted to maintain the valve at a distance from the sealing edge during evacuation of water. A transmission and lifting system is provided for moving the valve, and a push-button control device activates the transmission and lifting system. The transmission and lifting system includes a buoyancy chamber having a first base, with the buoyancy chamber being arranged in an upper portion of a housing in which the floater is housed and being associated with a rapid evacuation mechanism comprising at least one element activatable by the push-button control device, and at least one orifice in the first base or in a vicinity of the first base of the buoyancy chamber. The rapid evacuation mechanism is placed in an operative position when the push-button control device is pressed and in an inoperative position when the push-button control device is no longer pressed.

21 Claims, 6 Drawing Sheets

STOPPABLE FLUSHING MECHANISM WITH ASSURED MINIMAL FLOW

This application is a continuation of application Ser. No. 07/723,071, filed Jun. 28, 1991, now abandoned.

BACKGROUND OF THE INVENTION

1. Field of the Invention

The present invention is related to a "stoppable" flushing mechanism, with assured minimal flow, for the flushing tanks of toilets, the neologism "stoppable" meaning: whose action may be stopped.

2. Discussion of Background Information

Flushing mechanisms are known (EP-A-0,124,458, EP-A-0,128,847, FR-A-2,591,250, FR-A-2,580,694) that include a mobile valve in axial translation and adapted to be applied on the edge of the evacuation orifice arranged in the base of the flushing tank, this valve being mounted at the end or in the lower portion of a tubular rod, which is itself affixed to a floater, whose function is to maintain the valve at a distance from its seat, during the process of evacuating water or flushing: these flushing mechanisms also include a push-button control device, and a transmission or lifting system for the valve, activated by the said push-button.

According to these mechanisms, when the control push-button has been pressed, and the flushing process started, this process can no longer be interrupted, and the valve only falls back on its seat after the complete evacuation of the tank. Although this result is often desirable, it can also constitute a disadvantage when the bowl can be well flushed with a quantity of water that is substantially less than the capacity of the tank. This results in the use of excessive quantities of water, and is undesirable both for the user as well as for society at large.

FR-A-2,548,328 tries to overcome this disadvantage by an activating device for the flow valve, comprising a control push-button device affixed to a pushing member able to slide axially, and connected, by means of a joint, to a pusher head, able to pivot laterally in a limited manner, from one side to the other of its sliding axis, so as to act on one or the other of the two arms of a rocking lever, one of the arms of this lever being connected, via mismatched transmission members, to the flow valve, such that when the pivoting pusher head rests on one or the other of the arms of the pivoting lever, an ascending traction action is exercised, bringing about the lifting of the valve, or a descending pusher action brings about the lowering of the latter in the direction of its seat.

The main disadvantage of this device is that it does not transmit axial forces to the tube equipped with the flow valve, such that the longitudinal translation of the tube-flow valve assembly is not perfect, which increases the amount of force necessary to bring about the displacement of the assembly, especially in the upward direction, and may bring about, in the long run, a misalignment of the mobile equipment of the flushing mechanism, as well as an inappropriate application of the valve on its seat, giving rise to leaks.

Another major disadvantage of this device is the fact that it enables the flushing process to be stopped at any time after it has been activated, such that the influx of water may be stopped before the bowl has been completely cleaned, and that inefficient quantities of evacuated water are wasted; the use of such a device therefore does not ensure desirable cleanliness and hygiene.

SUMMARY OF THE INVENTION

One object of the present invention is thus to overcome the above-mentioned disadvantages, and, especially, the last mentioned disadvantage.

According to the invention, this object is achieved by virtue of a flushing mechanism comprising a buoyancy chamber arranged in the upper portion of the mechanism, and in which a floater is housed, which is affixed in axial translation to the sealing valve of the evacuation orifice, this buoyancy chamber being completed by quick evacuation means including at least one element connected to the push-button, and at least one orifice provided at the base or in the vicinity of the base of the chamber, these means being placed in an operative position when the push-button is pressed, and in an inoperative position when the latter is no longer pressed.

By virtue of this mechanism, it is possible to stop the flow of water in the direction of the bowl, but this interruption can only be obtained after evacuation of several liters of water. In this way, there is obtained the advantage of benefiting from stopping the flushing process, and saving water, while ensuring the flow of an efficient "minimum" volume of water as a guarantee of hygiene.

BRIEF DESCRIPTION OF THE DRAWINGS

The aims, characteristics and advantages mentioned above, will become more apparent from the description that follows, and from the annexed drawings in which.

DETAILED DESCRIPTION OF THE PREFERRED EMBODIMENTS

Figure 1:
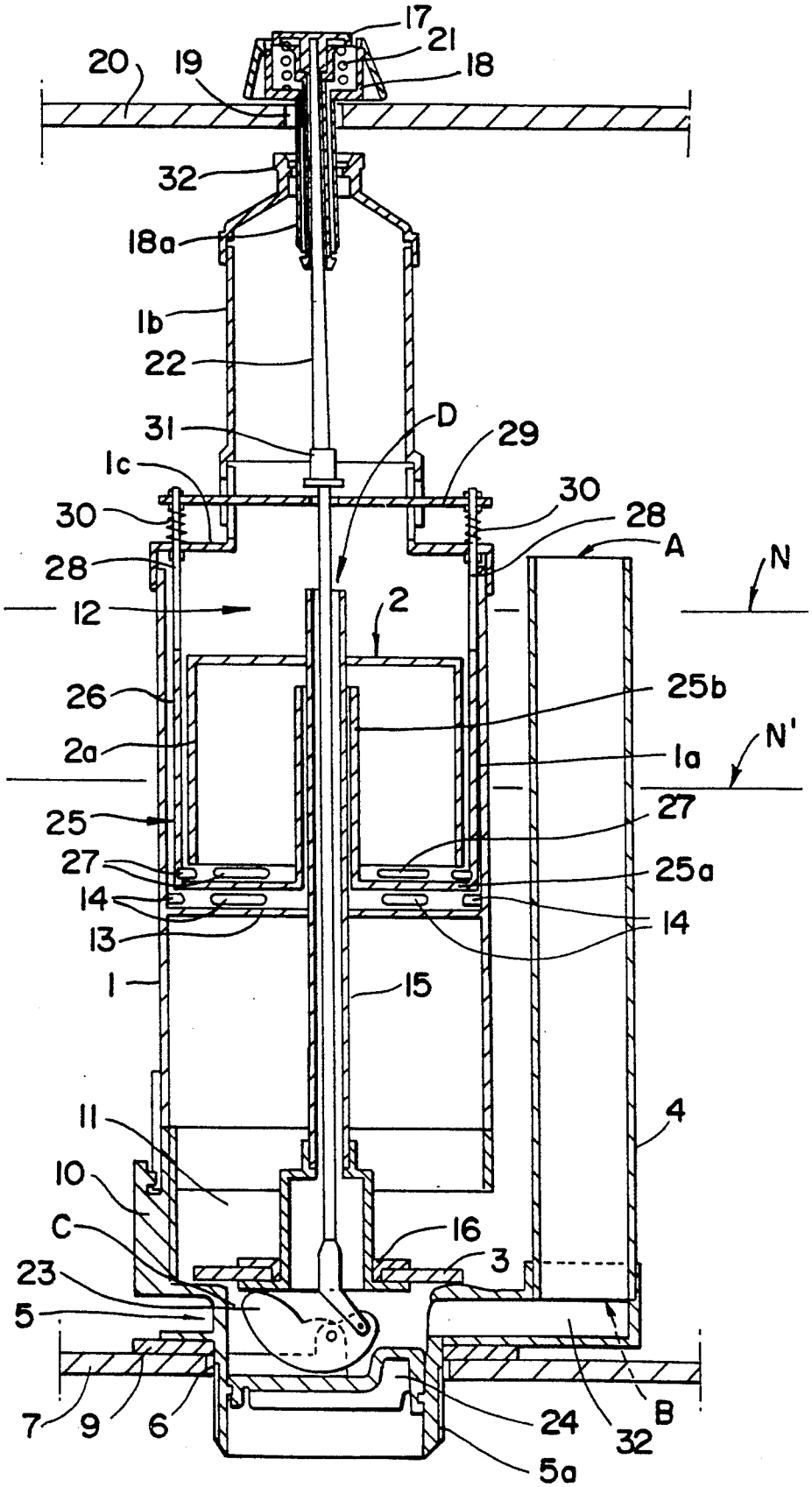
FIG. 1 is an axial sectional view of a first embodiment of the flushing mechanism according to the invention, shown installed in a flushing tank, whose base and lid has only been represented partially, the mechanism being in a position of rest.
Figure 2:
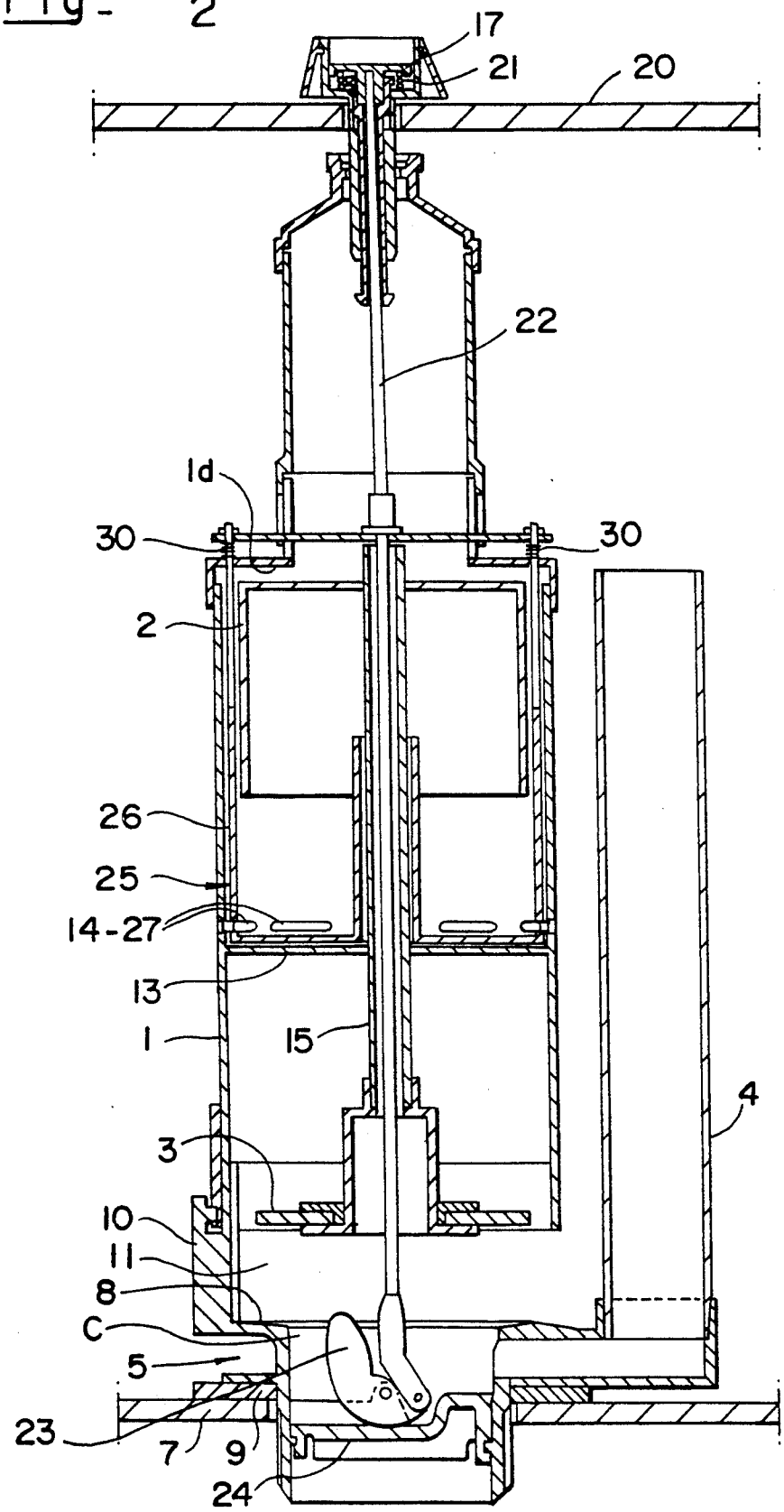
FIG. 2 is a view similar to FIG. 1, and represents the push-button after it has been pressed, having brought about the lifting of the mobile system and the opening of the evacuation orifice.

Below are described two interesting and non-limiting embodiments of the stoppable flushing mechanism, with assured minimum flow, according to the invention.

According to the embodiments illustrated in FIGS. 1–6, this mechanism includes:

- an external envelope or housing 1 of a general cylindrical shape;
- a floater 2 with an aptitude for vertical displacement, housed in the envelope, and affixed, in axial translation, to the sealing valve 3 of the evacuation orifice of the tank;

an overflow tube 4 provided with an upper orifice A and lower orifice B, so as to enable automatic emptying when it is overfull, as this may result in a defective closing of tap controlling the entry of water into the tank;

a push-button control system enabling the valve to be lifted;

a base designated in its entirety by the numerical reference 5, and adapted to be installed fixedly in the orifice 6 of base 7 of the tank (partially represented in FIGS. 1–4).

Base 5 has a central orifice C whose circular upper edge 8 constitutes the seat of valve 3.

When the flushing mechanism is positioned inside a flushing tank which is itself fixed to the bowl of a toilet, the base 5 is fixedly installed, by means of a screw (not represented), that is screwed onto the threaded lower cylindrical portion 5*a* of the base, in orifice 6.

In this way, the central orifice C of base 5 constitutes the evacuation orifice of the tank. The water tightness between base 7 of the tank and the foundation or support surface of base 5, is achieved by means of an intermediate annular joint 9 made of rubber or any other adequate material.

The base of the external envelope 1 and the base 5 are arranged to be complementarily provided with complementary junction means enabling them to be assembled rigidly, in a separable manner, and at the same time enabling the passage of water between the base (of the external envelope) and the base 5. The base 5 is, for example, provided with three latching forks 10 spaced from one another at 120°, and between whose branches the base of envelope 1 may be engaged and retained. Between the latching forks, broad openings 11 can thus be found for the passage of water.

According to the invention, the upper portion of envelope 1, is arranged so as to constitute an auxiliary tank 12 or buoyancy chamber.

The upper portion 1*a* of the envelope 1 constitutes the lateral wall of this tank, whose base is formed, according to the embodiment illustrated in FIGS. 1–4, by a circular partition, wall, or base 13. In the vicinity of base 13, the lateral wall 1*a* of tank 12 is provided with evacuation orifices 14 distributed on the periphery of the wall, these orifices being placed above the base according to the embodiment illustrated in FIGS. 1–6.

The orifices 14 are arranged approximately in the median portion of the height of envelope 1 and of the flushing mechanism, and at a level very clearly below the level at which the upper orifice A of the overflow tube 4 is located, for example, approximately mid-way up the latter.

The floater 2 of the flushing mechanism is housed within the buoyancy chamber 12. This floater is advantageously constituted by a bell, open at its base and closed on top, this bell being rigidly affixed to the surface of tube 15 by means of which it is connected to valve 3. The latter is, for example, constituted by a sealing joint in the shape of a circular crown, made of rubber or any other adequate material, and it is installed in the peripheral groove of a rigid frame 16 constituting the lower end of the tube 15.

In a very interesting manner, the push-button control system is of the type described and illustrated in document FR-A-2,591,250. This control system enables the lifting of valve 3, and includes:

a push-button 17, axially and vertically movable, this push-button being housed in a plate 18 adapted to be fixedly installed in a hole 19 of the lid 20 of the flushing mechanism for the passage of the rod of the control devices; this plate 18 is, for example, affixed to a tubular rod 18*a* provided with a threaded exterior by means of which it is screwed in the screw 32 constituted by the cap 1*b* forming the top of the external envelope 1;

a spring 21 acting in compression and tending to push back the push-button 17, toward the exterior, that is to say, towards the top; this spring being, for example, wedged, via its opposing ends against the lower surface of the push-button, and against the base of plate 18;

an axial transmission rod 22 affixed in axial translation to the push-button 17, and which may be connected to the latter by means of its upper end; this transmission rod longitudinally crosses the mobile equipment 2-15-3;

and a lifting element 23 mounted with an aptitude for pivoting at the lower end of the transmission rod 22 and located below valve 3; this element is, for example, constituted by a cam or small lever of the first type, whose oscillation axis is carried by a traverse member 24 located fixedly through the evacuation orifice of base 5, below the seat of the valve.

The mechanism according to the invention also includes means enabling rapid evacuation of the buoyancy chamber 12. According to the embodiment illustrated in FIGS. 1–6, these means comprise, other than the orifices 14 described previously, a plug constituted by the cylindrical lateral wall 26 of an annular, auxiliary tank 25, provided, with an aptitude for axial displacement around the tube 15. This auxiliary tank 25 is open at its upper part and, its lateral wall 26 includes, in the vicinity of base 25*a* of the tank, orifices 27 whose shape, number, and distribution correspond to the shape, number and distribution of orifices 14, with respect to which they may be placed. The lateral wall 2*a* of floater 2 is housed in the ring shaped auxiliary tank 25, the height of this wall being substantially equal to the height of internal cylindrical wall 25*b* of the tank. On the other hand, the external lateral wall 26 of the ring-shaped auxiliary tank 25 has a height which is substantially more than that of internal wall 25*b* of the tank.

When the wall 1*a* is placed in front of orifices 27, the latter are blocked, but not such that they are strictly water tight, by the wall.

The tube 15 includes a tubular extension whose upper orifice D is placed substantially at the level where orifice A of the overflow tube 4 is located, when the device is at rest, and preferably, a little below this level.

The lateral wall 26 of the auxiliary tank 25, which acts as a plug, is rigidly affixed to two small columns or connecting rods 28 oriented upwardly and diametrically opposed. A horizontal drive bar 29, arranged perpendicularly to rods 28, rigidly connects the upper portion of the latter. The springs 30 acting in compression are provided around the upper portions of rods 28. These springs are wedged against the lower surface of the small bar 29, and against a circular shoulder 1*c* of the external envelope 1.

Springs 30 tend to push back the drive bar 29 towards the top and thus maintain, plug wall 26 and the auxiliary tank 25 in a raised position.

The transmission rod 22 is provided with a pushing element enabling the assembly, including plug wall 26 and auxiliary tank 25 to be lowered when push-button 17 is pressed. This pushing element is, for example, constituted by a ring 31 wedged on rod 22, and provided above the small bar 29, and, preferably in contact with the latter.

The overflow tube 4 of the flushing mechanism is located outside envelope 1. Its lower orifice B is connected to base 5 by a conduit 32 ending in the base, below seat 8 of valve 3.

The functioning of this embodiment of the flushing mechanism according to the invention will be described below.

During filling out or at rest, the mobile equipment 2-15-3 is in a lowered position, the valve 3 resting on its seat 8 and blocking the evacuation orifice C. On the other hand, the push-button 17 and the pusher ring 31 are in a raised position, as well as plug wall 26 and auxiliary tank 25. In this position, orifices 27 of auxiliary tank 25 are placed above the level of orifices 14 of wall 1*a*, and are thus blocked by the latter. At the end of the filling process, the level N of the water contained in the tank is generally a little below the positioning of the upper ends of the overflow tube 4 and of the tubular extension 15*a* of the tube 15, such that the overflow tube may fulfill its function in case of defective closing of the supply tap. The water also fills the buoyancy chamber 12 and the auxiliary tank 25, housed in the latter.

By pressing on the push-button 17, the transmission and lifting system including the transmission rod 22 and the lever 23 is activated, with the transmission rod 22 being made to come down, and the rocking of lever 23 assuring the lifting of valve 3, and of the mobile equipment 2-15-3. The water flows toward the evacuation orifice C, through openings 11 arranged between the base of envelope 1 and the upper surface of base 5, and the floater 2 communicates an additional upward movement to the mobile equipment 2-15-3 (see FIG. 2) whose upward displacement is stopped by an internal shoulder 1*d* of the envelope 1 against which the top of floater 2 abuts. It should be noted that the downward movement of rod 22 also brings about, by the action of the pusher ring 31, the downward movement of the auxiliary tank 25 and of plug 26 whose orifices 27 are aligned with orifices 14 of the lateral wall 1*a*. However, this has no effect because water is present both outside and inside envelope 1.

Figure 3:
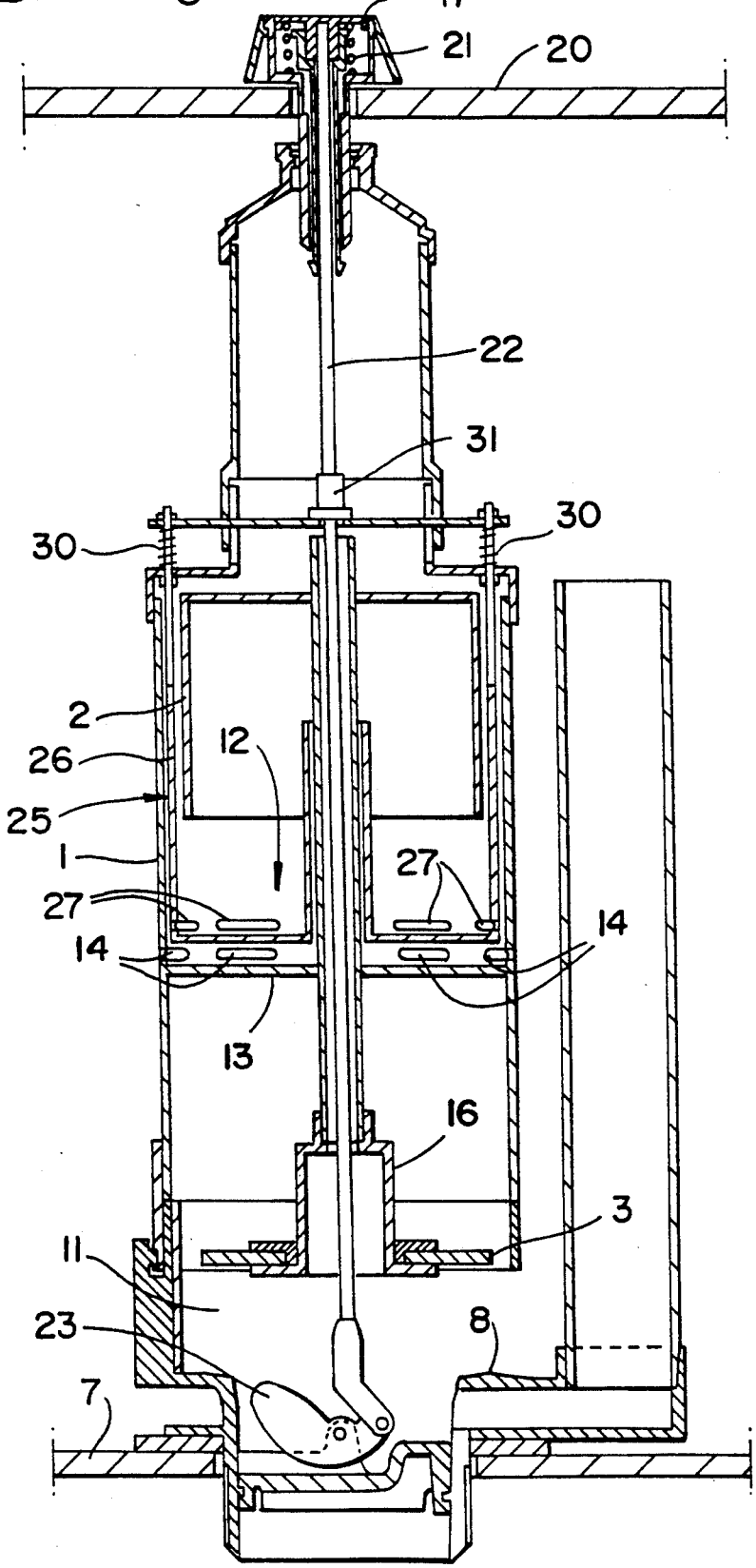
FIG. 3 is a quasi-identical view of FIG. 2, and illustrates a position of the control device, after the push-button has been relaxed, during evacuation of water.
Figure 4:
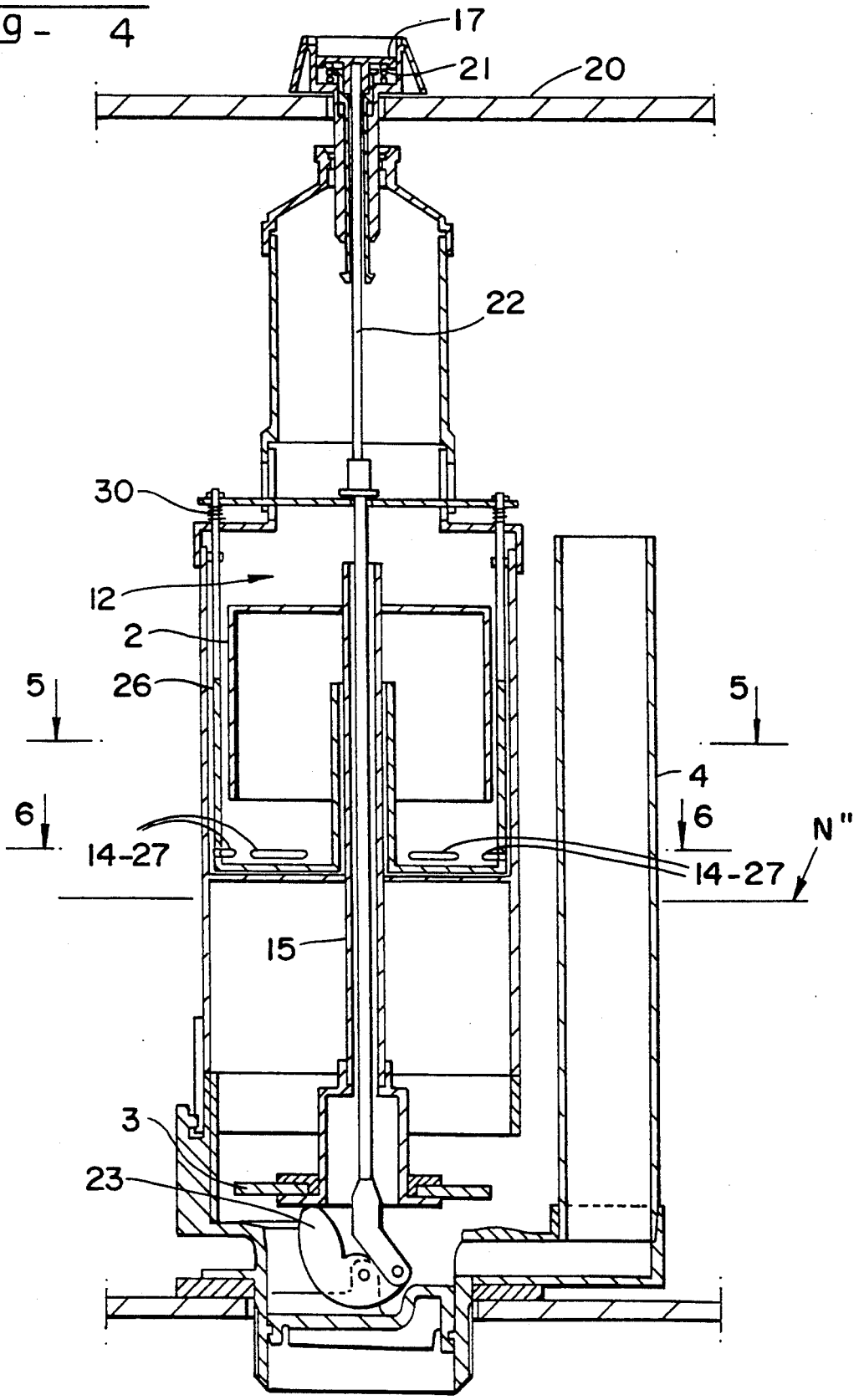
FIG. 4 is a view similar to the preceding figures, and shows a deliberate stopping of the evacuation of water, during the process of evacuation of the tank, by pressing on the push-button.
Figure 5:
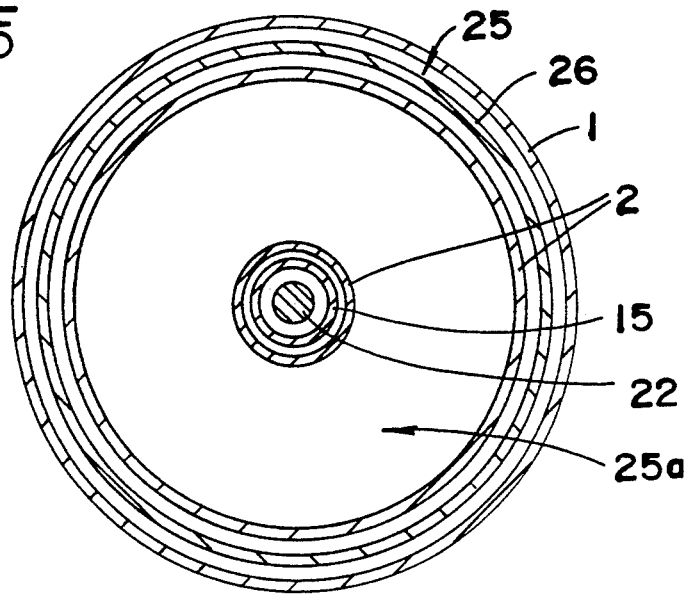
FIG. 5 is a transverse section on a larger scale, along line 5—5 of FIG. 4.
Figure 6:
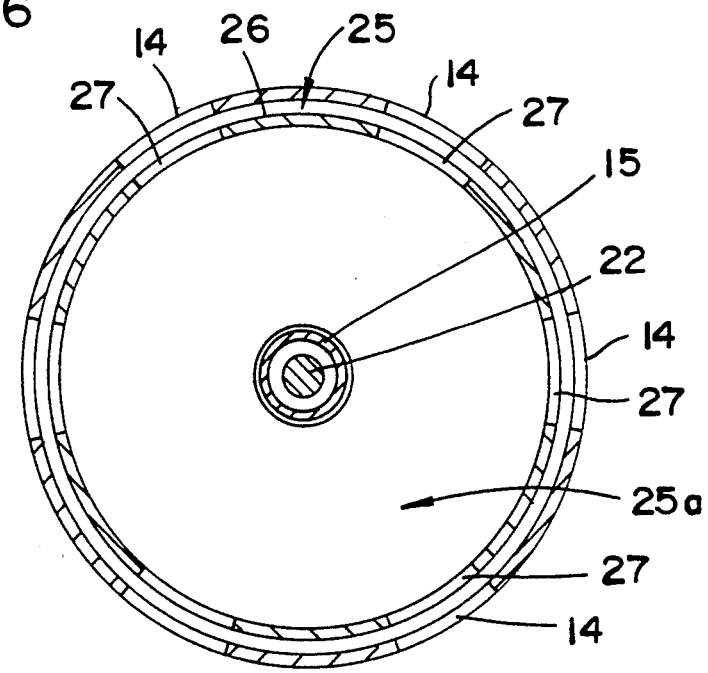
FIG. 6 is a transverse section on a larger scale, along line 6—6 of FIG. 4.

When the push-button 17 is relaxed it ascends under the action of spring 21, bringing about a corresponding upward movement of the transmission rod 22 and pusher ring 31, whereas the rocking lever 23 once again takes its initial position (FIG. 3). Simultaneously, plug wall 26 of the auxiliary tank 25 ascends again under the action of springs 30.

During a total evacuation of the tank, the mobile equipment 2-15-3 remains in a lifted position as long as the floatability of the floater remains assured. The level of the water contained in the flushing tank falls progressively and rapidly, whereas the level of the water contained in the buoyancy chamber 12, and more precisely in the auxiliary tank 25 also falls, but much more slowly because of the fact that orifices 27 arranged in the vicinity of the base of the latter are blocked in a non-water-tight fashion by the plugging cylindrical wall 26. The mobile equipment 2-15-3 falls naturally in its resting position and in a position of blocking the evacuation orifices C (see FIG. 1) when there is no more water in the auxiliary tank 25, and the buoyancy of floater 2 is no longer assured.

It is possible to interrupt the evacuation process, but not before the descending level of water contained in the flushing tank has reached orifices 14, that is, not before a certain volume of water has been evacuated.

In fact, if one presses on the push-button 17 when the level N′ of the water contained in the flushing system is located above orifices 14, the downward movement of the plug 26-auxiliary 25 assembly, and the corresponding positioning of orifices 14 and 27 will not permit a rapid evacuation of water contained in the auxiliary tank, and, for reason explained previously, the buoyancy of floater 2 will remain assured.

Conversely, if one presses push-button 17 when the descending level N″ of the water contained in the flushing system has reached or crossed orifices 14, the corresponding positioning of the orifices 14 and orifices 27 enables the rapid evacuation of the auxiliary tank and the downward movement of the mobile equipment 2-15-3. (FIG. 4), evacuation being stopped as soon as the push-button is relaxed, enabling valve 3 to fall on its seat 8.

Figure 7:
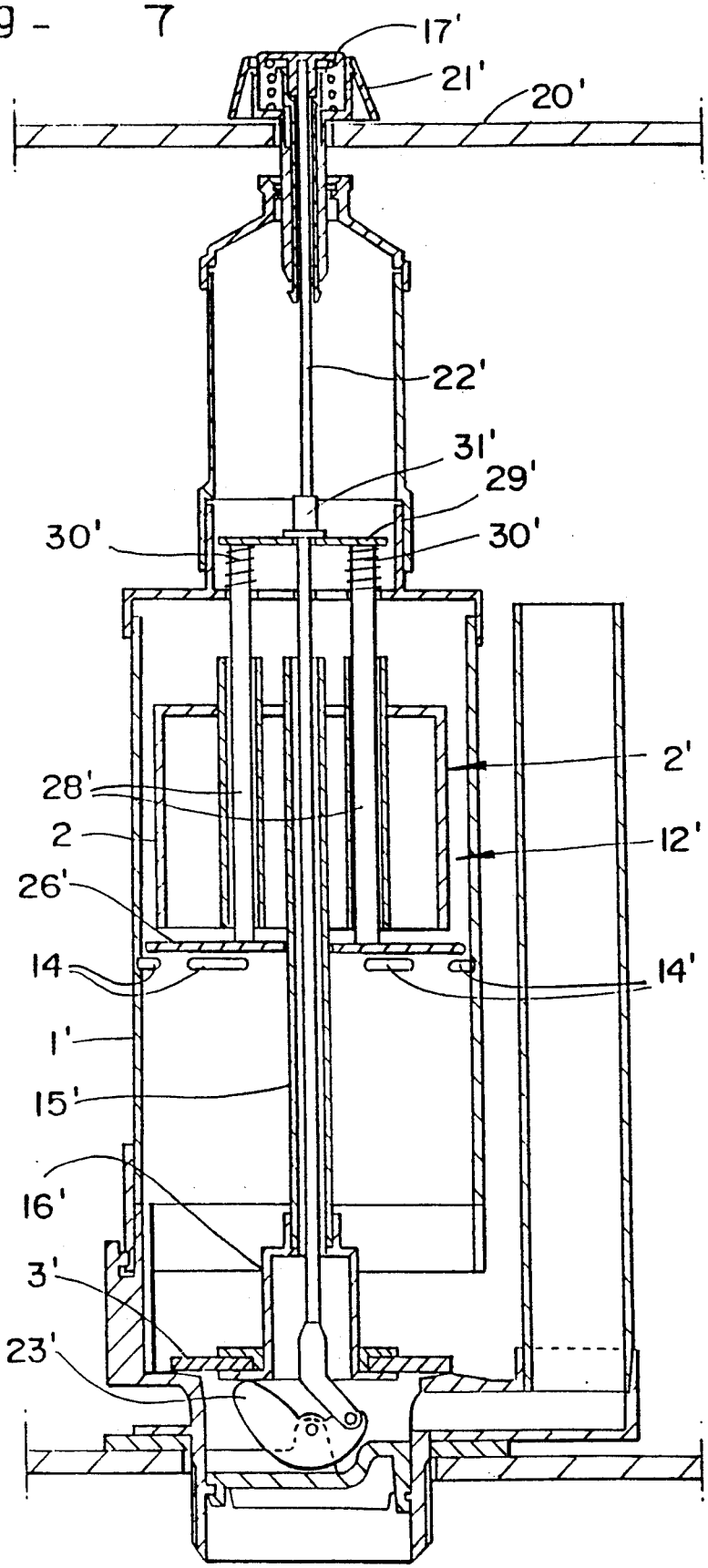
FIG. 7 is an axial sectional view of a second embodiment of the flushing mechanism according to the invention, represented in a resting position.

The embodiment of the flushing element illustrated in FIG. 7, with like reference numerals being indicated with primes, differs from the one described previously, mainly by the fact that the buoyancy chamber 12′ does not enclose an auxiliary tank and that the plug 26′ enabling the positioning or lack of it, of orifices 14′ arranged in the lateral wall of envelope 1′, in relation with said chamber, is constituted by the mobile base of this latter.

According to this embodiment, the mobile plug 26′ is constituted by a circular plate provided around a tube 15′ adapted to slide in a non water-tight fashion, along the latter and the internal surface of envelope 1. This plate 26′ constituting the mobile base of the buoyancy chamber 12′, is connected, by means of two vertical and parallel rods or columns 28′, to a drive bar 29′. The spring 30′ tends to maintain assembly 26′-28′-29′ in a raised position, in the manner described previously.

The flushing mechanism achieved according to this embodiment also enables the evacuation process to be stopped by pressing on the push-button 17′ a second time, but this stopping can only take place when the descending level of water has reached orifice 14′.

We claim:

1. A stoppable flushing mechanism having an assured minimum flow capable of dispensing two levels of water from a flushing tank of a toilet, comprising:

means defining an evacuation orifice including a sealing edge and, adapted to be positioned in a base of said flushing tank, for permitting water to be evacuated from the flushing tank;

a housing defining a substantially vertical axis and having an upper portion and a lower portion defined by a partition;

a valve movable in a direction substantially along said substantially vertical axis for displaceably contacting said sealing edge;

a floater movable in a direction substantially along said substantially vertical axis, said floater being affixed to said valve and adapted to maintain said valve at a distance from said sealing edge during evacuation of water from the flushing tank;

a transmission and lifting system for moving said valve from a position on said sealing edge; a push-button control device for activating said transmission and lifting system;

a buoyancy chamber having a first base, said buoyancy chamber being positioned in said upper portion of said housing and said floater being positioned within said buoyancy chamber; and a rapid evacuation mechanism for rapidly evacuating said buoyancy chamber, comprising at least one element activatable by said push-button control device, and at least one first orifice in a vicinity of said first base of said buoyancy chamber, said at least one element being placed in an operative position to permit rapid flow of water from said buoyancy chamber through said at least one first orifice when said push-button control device is pressed and water in the flushing tank is at a level below said at least one first orifice, thus allowing said floater to descend causing said valve to close, retaining a portion of said water in said tank, and in an operative position to stop rapid flow of water from said buoyancy chamber when said push-button control device is no longer pressed.

2. The stoppable flushing mechanism according to claim 1, wherein said means defining an evacuation orifice comprises a second base having a substantially central opening which is adapted to be fixedly installed on a lower opening of a tank.

3. The stoppable flushing mechanism according to claim 2, wherein said housing comprises a first lateral wall of a substantially cylindrical external envelope forming said buoyancy chamber, and a lower portion of said first lateral wall comprises a third base connected to said second base.

4. The stoppable flushing mechanism according to claim 3, wherein said transmission and lifting system comprises a transmission rod connected to said push-button control device, and said at least one element of said rapid evacuation mechanism comprises a mobile plug member.

5. The stoppable flushing mechanism according to claim 4, wherein said at least one first orifice is positioned in said first lateral wall in a vicinity of said first base of said buoyancy chamber, and said at least one first orifice is placed in communication with said buoyancy chamber when said push-button control device is pressed.

6. The stoppable flushing mechanism according to claim 5, wherein said first base of said buoyancy chamber is movable and said mobile plug member comprises said movable first base.

7. The stoppable flushing mechanism according to claim 6, wherein said movable first base of said buoyancy chamber is positioned above said at least one first orifice in said lateral wall of said external envelope when said push-button control device is in a raised, resting position defining the inoperative position, and below said at least one first orifice when said push-button is pressed and is in the operative position.

8. The stoppable flushing mechanism according to claim 4, wherein said mobile plug member is connected to elastic means for causing said mobile plug member to move to a raised position.

9. The stoppable flushing mechanism according to claim 8, wherein said mobile plug member is connected, by means of connecting columns, to a drive bar.

10. The stoppable flushing mechanism according to claim 9, wherein said transmission rod includes a pusher element arranged above said drive bar.

11. The stoppable flushing mechanism according to claim 10, wherein said pusher element contacts said drive bar in the raised position.

12. The stoppable flushing mechanism according to claim 9, wherein said elastic means comprise springs arranged around upper ends of said connecting columns.

13. The stoppable flushing mechanism according to claim 12, wherein said springs are wedged against said drive bar and against a shoulder of said external envelope.

14. The stoppable flushing mechanism according to claim 1, wherein said transmission and lifting system comprises a transmission rod connected to said push-button control device, and said at least one element of said rapid evacuation mechanism comprises a mobile plug member.

15. The stoppable flushing mechanism according to claim 14, wherein said mobile plug member comprises a second lateral wall of a ring-shaped auxiliary tank positioned in said buoyancy chamber.

16. The stoppable flushing mechanism according to claim 15, wherein said floater comprises a floating bell having a third lateral wall positioned in said ring-shaped auxiliary tank.

17. The stoppable flushing mechanism according to claim 16, wherein said housing comprises a first lateral wall of a substantially cylindrical external envelope, and said second lateral wall of said ring-shaped auxiliary tank comprises at least one second orifice blocked in a non-water-tight fashion by said first lateral wall when said push-button control device is in a raised, resting position defining the inoperative position, and said at least one second orifice is placed in communication with said at least one first orifice when said push-button control device is pressed and is in the operative position.

18. The stoppable flushing mechanism according to claim 14, wherein said mobile plug member is connected, by means of connecting columns, to a drive bar.

19. The stoppable flushing mechanism according to claim 1, wherein said floater is affixed to an upper part of a tube, and said tube rigidly connects said floater to said valve.

20. The stoppable flushing mechanism according to claim 19, wherein said transmission and lifting system comprises a transmission rod passing through said tube, and an element for lifting said valve.

21. The stoppable flushing mechanism according to claim 20, wherein said element for lifting said valve comprises a pivotable member at a lower end of said transmission rod.

* * * * *